US005554812A

United States Patent [19]

Donohoe

[11] Patent Number: 5,554,812

[45] Date of Patent: Sep. 10, 1996

[54] DRUM HEAD AND TENSIONING HOOP WITH POSITIONING AND T-LOCK RIDGES

[75] Inventor: David G. Donohoe, Springville, Calif.

[73] Assignee: Aquarian Accessories Corporation, Anaheim, Calif.

[21] Appl. No.: 395,625

[22] Filed: Feb. 28, 1995

[51] Int. Cl.[6] ..... G10D 13/02

[52] U.S. Cl. ..... 84/413; 84/414

[58] Field of Search ..... 84/411 R, 413, 84/414

[56] References Cited

U.S. PATENT DOCUMENTS

| | | | |
|---|---|---|---|
| 3,272,057 | 9/1966 | Saito | 84/414 |
| 3,668,296 | 6/1972 | Criscuolo | 84/414 |
| 4,779,508 | 10/1988 | Beals | 84/414 |
| 4,809,582 | 3/1989 | Chang | 84/414 |

*Primary Examiner*—Patrick J. Stanzione
*Attorney, Agent, or Firm*—William L. Chapin

[57] ABSTRACT

A drumhead for musical percussion instruments includes a synthetic polymer membrane secured to a ring-shaped tensioning hoop having a uniform cross-sectional shape in which is formed in the upper surface thereof a generally U-shaped channel. A positioning lip or ridge protruding downwards and inwards into the channel from the outer circumferential wall of the hoop limits upward movement of the outer vertically disposed annular wall of a peripheral hoop mounting section of the membrane which has been molded into a U-shaped cross section maintained by elastic memory, thereby precisely locating the membrane with respect to the hoop when the peripheral section of the membrane is inserted into the hoop channel. In the preferred embodiment, the bottom flat wall of the membrane hoop-mounting section is supported by a pair of radially opposed and aligned ledges or ridges located above the bottom wall of the channel and protruding inwards from opposite channel walls, forming an inverted T-shaped sub-channel within the U-shaped channel. Circumferentially spaced apart perforations provided through the flat bottom wall of the membrane hoop-mounting section are radially positioned so as to overlie the space between the ledges. Thus, liquid polymer poured into the upper opening of the tensioning hoop permeates the holes, and when solidified into a polymer ring, forms a plurality of inverted T-shaped lugs which securely lock the ring and membrane to the tensioning hoop.

20 Claims, 3 Drawing Sheets

DRUM HEAD AND TENSIONING HOOP WITH POSITIONING AND T-LOCK RIDGES

BACKGROUND OF THE INVENTION

A. Field of the Invention

The present invention relates to percussive musical instruments, specifically drums. More particularly, the invention relates to an improved drum head construction.

B. Description of Background Art

A variety of drums are used by orchestras, bands and other musical groups. Drum types include kettle drums or tympani, base drums and snare drums. All of these drums utilize as striking or battering surfaces drum head membranes made of animal skins or synthetic polymer sheets held in tension over the open end of a cylindrical shell. Now the fundamental frequency, overtones, and resonance, i.e., vibration decay or dampening time of a drum are determined primarily by vibration modes excited in the drum head when it is struck by a drumstick, mallet, hand or other object. The frequency and dampening of drum head vibration modes is in turn determined by size, weight, compliance, and other such properties of the drum head, but primarily by the tension exerted on the drum head membrane, usually by means of an adjustable hoop attached to the drum head membrane and clamped to the shell. Therefore, producing desired tones from a drum requires that tension in the drum head be accurately and uniformly adjusted by the drum hoop tensioning means.

Modern drums, particularly those using drum head membranes made of synthetic polymer films, often use a circular sheet of polymer film secured permanently to a first, tensioning hoop. The tensioning hoop is placed over an open end of a cylindrical shell, with the outer annular region of the lower surface of the film contacting the upper annular surface of the shell. The drum head membrane is then brought into tension by a counter-tensioning hoop secured over the first, integral drum head tensioning-hoop. This is accomplished by utilizing adjustable, circumferentially spaced apart, longitudinally disposed tensioning clamps to exert axially downwardly directed forces on the counter-tensioning hoop, which in turn exerts a downward axial force on the integral drum head hoop. Downward axial forces on the drum head hoop cause the drum head membrane to slide or pivot radially outwards on the upper annular surface of the drum head shell, thereby producing radially outwardly directed tension forces in the drum head. Thus, the upper annular shell surface functions as a bearing or fulcrum, and is sometimes tapered to a thinner, knife-shaped cross section to facilitate the fulcrum action.

In snare drums and other drums having opposed upper and lower drum heads, the two heads are usually tensioned simultaneously by a plurality of circumferentially spaced apart tensioning clamps on the outer cylindrical surface of the drum shell. Each tensioning clamp, which is similar to a turnbuckle, utilizes a central axially elongated lug that has axially aligned, threaded upper and lower bores. The threaded bores threadingly receive upper and lower tensioning rods attached at the outer ends thereof to flanges that protrude outward at circumferentially spaced apart locations from the upper and lower counter tensioning hoops. By screwing either of the tensioning rods into or out of a lug, tension in both upper and lower drum heads may be increased or decreased to a desired value.

Typical drum head membranes are made of polyester film and are tightened to substantial tensions. Because of the substantial tension forces, the outer annular peripheral region of a drum head membrane has a tendency to pull loose and separate from the hoop to which it is fastened, as a result of static tension forces produced by the tensioning through the counter-tensioning hoop, and as a result of dynamic tensions resulting from impacts on the drum head.

One prior art approach to preventing a drum head membrane separating from the tensioning hoop to which it is attached utilizes a plurality of circumferentially spaced apart holes formed through a vertically disposed, annular flange wall of the drum head membrane that depends downwardly from the disk-shaped upper surface of the membrane into the upper opening of an annular channel formed in the hoop. The channel is filled with a liquid polymer which is allowed to harden, cementing the drum head membrane to the hoop. The intended purpose of the holes in the flange wall of the drum head membrane is to allow liquid polymer to flow through the holes and solidify into retaining pins integral with solidified polymer rings formed in the hoop channel on both the inner and outer radial sides of the flange wall. However, in drum heads so constructed, portions of the membrane have a tendency to slip out of the tensioning hoop channel, thereby detuning the drum head, or to tear out of the hoop channel. The present invention was conceived of to provide a drum head construction in which the drum head membrane has an increased resistance to pulling apart from its tensioning hoop.

OBJECTS OF THE INVENTION

An object of the present invention is to provide a drum head construction for musical instruments in which the drum head membrane is locked securely to an integral tensioning hoop, to prevent detachment from the hoop.

Another object of the invention is to provide a drum head having a membrane interlocked with an integral tensioning hoop to prevent slippage of the membrane with respect to the hoop.

Another object of the invention is to provide a drum head tensioning hoop which precisely locates the outer annular edge of a drum head membrane relative to the tensioning hoop.

Another object of the invention is to provide a drum head tensioning hoop which locks the outer annular edge of a drum head membrane at a precise position upon inserting the edge into a channel formed in the hoop, holding the drum head in proper relationship with respect to the hoop while liquid polymer is poured into the channel and allowed to solidify.

Another object of the invention is to provide a drum head construction in the upper portion in which an inverted T-shaped subchannel formed in the lower portion of an annular tensioning hoop having a U-shaped cross section cooperates with a plurality of circumferentially spaced apart holes formed in the horizontally disposed outer annular surface of a drum head membrane resting on inwardly protruding upper walls of the subchannel to form a T-shaped locking structure upon solidification of liquid polymer filling the hoop.

Various other objects and advantages of the present invention, and its most novel features, will become apparent to those skilled in the art by perusing the accompanying specification, drawings and claims.

It is to be understood that although the invention disclosed herein is fully capable of achieving the objects and providing the advantages described, the characteristics of the invention described herein are merely illustrative of the preferred embodiments. Accordingly, I do not intend that the scope of my exclusive rights and privileges in the invention be limited to details of the embodiments described. I do intend that equivalents, adaptations and modifications of the invention reasonably inferable from the description contained herein be included within the scope of the invention as defined by the appended claims.

SUMMARY OF THE INVENTION

Briefly stated, the present invention comprehends an improved drum head employing a novel construction which both precisely positions and interlocks the periphery of a drum head membrane within an integral tensioning hoop.

The improved drum head construction according to the present invention includes a ring-shaped tensioning hoop formed from an elongated, hollow bar having formed therein a generally U-shaped channel of uniform transverse section, which is bent into a circular ring or hoop. The inner surface of the outer circumferential wall of the channel has formed therein an upper lip or flange that protrudes radially inward and downward from the upper edge of the outer channel wall. A drum head membrane, preferably made of a thin circular sheet of a synthetic polymer, has its outer peripheral edge bent into a U-shaped cross section which is inserted downward into the tensioning hoop channel, the outermost circular edge of the membrane abutting the bottom edge of the channel lip and thereby positioning the head at a precisely determined position within the hoop. The tensioning hoop channel also preferably has formed therein a pair of opposed inwardly protruding rectangular cross section ledges located above the bottom flat wall of the channel. The space between the opposed inner facing vertical walls of the ledges forms with the bottom wall of the U-shaped channel an inverted T-shaped sub-channel within the U-shaped channel. The flat annular bottom wall of the U-shaped peripheral edge of the drum head membrane rests on the upper transverse walls of the ledges when the membrane is inserted into the channel. Preferably, a plurality of circumferential spaced apart holes are formed through that portion of the peripheral edge of the drum head membrane overlying the space between the inner facing walls of the ledges. Liquid polymer poured into the U-shaped channel and allowed to flow through the membrane holes into the bottom of the inverted T-shaped sub-channel solidifies into T-shaped lugs which securely interlock the drum head membrane to the tensioning hoop. Additional securement of the solidified polymer ring within the tensioning hoop channel is provided by a counter tensioning hoop exerting a downward pressure on the upper surface of the solidified polymer ring.

DETAILED DESCRIPTION OF THE PREFERRED EMBODIMENTS

FIGS. 4 through 7 illustrate a novel drum head and tensioning hoop construction according to the present invention. Certain advantageous features of the drum head and tensioning hoop according to the present invention may be best appreciated by a comparison of the present invention to prior art articles shown in FIGS. 1 through 3.

Figure 1:
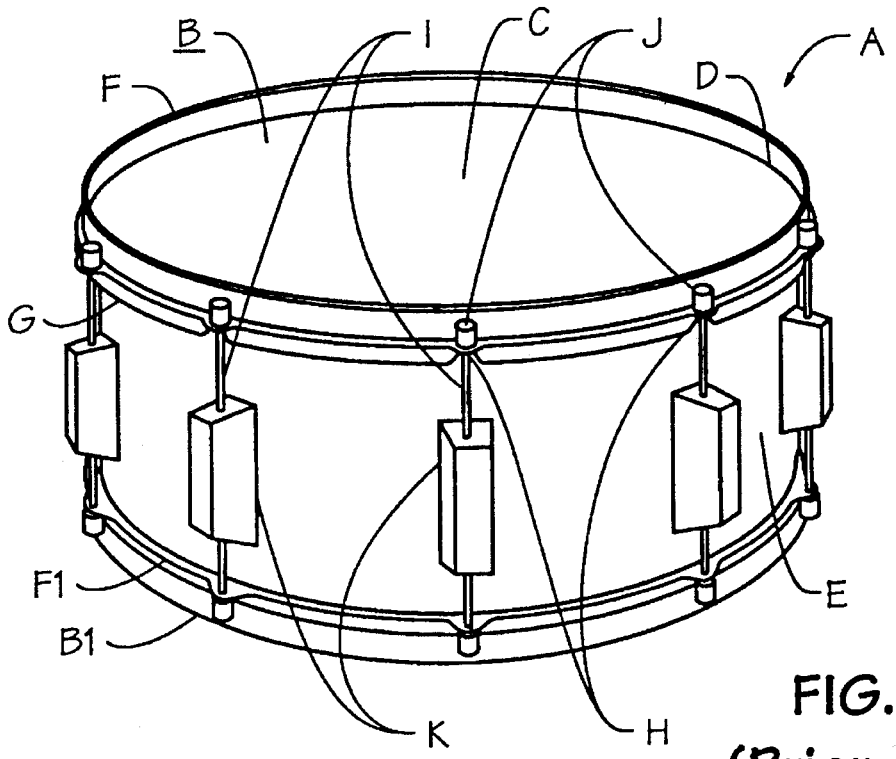
FIG. 1 (Prior Art)
FIG. 1 is a perspective view of a prior art snare drum.

Referring now to FIG. 1, a snare drum A is shown having an upper drum head B including a membrane C mounted peripherally within a tensioning hoop D. As shown in FIG. 1, drum head membrane C is held in tensioned contact with the upper annular end wall of a cylindrical shell E by means of a counter-tensioning hoop F. Counter-tensioning hoop F has a radially outwardly protruding lower flange G provided with circumferentially spaced apart perforations H, each insertably receiving an axially downwardly protruding upper tension rod I having a slotted head J. Each tension rod I has an externally threaded lower end which is threadingly received within a threaded bore of a lug K. Lug K may be attached to shell E of drum A. Usually, however, as shown in FIG. 1, lug K is unattached to shell E, but is instead secured by a lower tension rod I to a lower counter-tensioning hoop F1. This construction permits tension adjustments in lower drum head B1 (not shown) to be made simultaneously with tension adjustments in upper drum head B.

Figure 2:
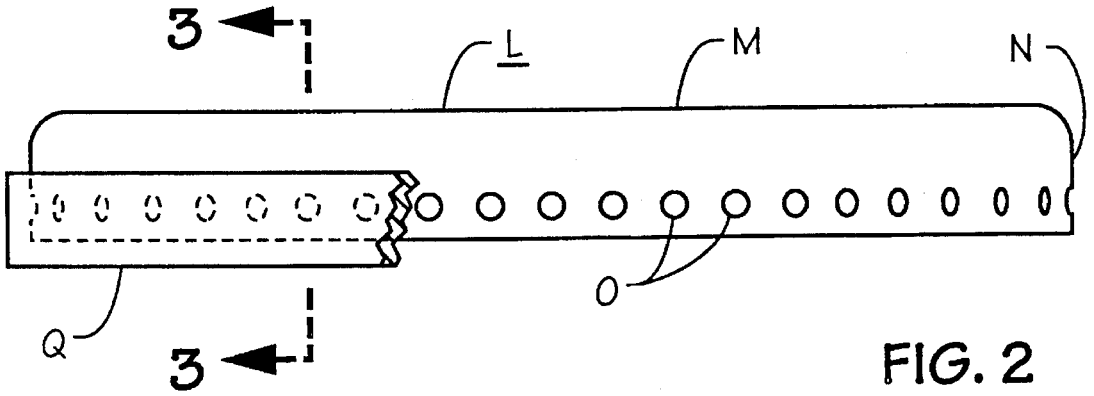
FIG. 2 (Prior Art)
FIG. 2 is a partly broken elevation view of a prior art drum head membrane.
Figure 3:
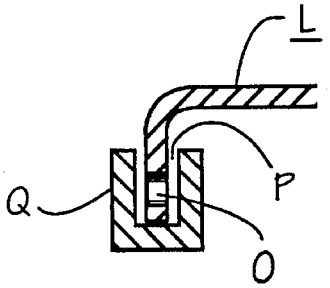
FIG. 3 (Prior Art)
FIG. 3 is a fragmentary sectional view of the drum head of FIG. 2.

Referring now to FIGS. 2 and 3, a prior-art method of securing a drum head membrane to a counter-tensioning hoop is shown. As shown in FIGS. 2 and 3, drum head membrane L has an upper circular disk-shaped section M and a vertically downwardly depending peripheral flange N. Vertically downwardly depending peripheral flange N is provided with a plurality of circumferentially spaced apart holes O. As may be seen best by referring to FIG. 2, flange N of drum head membrane L is insertably received within an upwardly opening, U-shaped channel P formed in the upper annular wall surface of an annular ring-shaped tensioning hoop Q. Flange N is secured within channel P by means of a solidified polymer poured in its liquid, unpolymerized state into channel P. However, for tensioning hoop rings of practical height, holes O are necessarily close to the lower or outer peripheral edge of flange N of membrane L. Thus, solidified polymer extending through the holes has a tendency to slip or tear through the membrane to the outer edge wall of the flange, when sufficient static or dynamic tension forces are exerted on the membrane.

FIGS. 4–7 illustrate a novel drum head and tensioning hoop construction according to the present invention, which provides means for precisely and uniformly positioning a drum head membrane with respect to the tensioning hoop, and in which the membrane is secured against slippage or tearing out from the tensioning hoop. The novel construction also facilitates adjustment and stability of drum head tuning.

Figure 4:
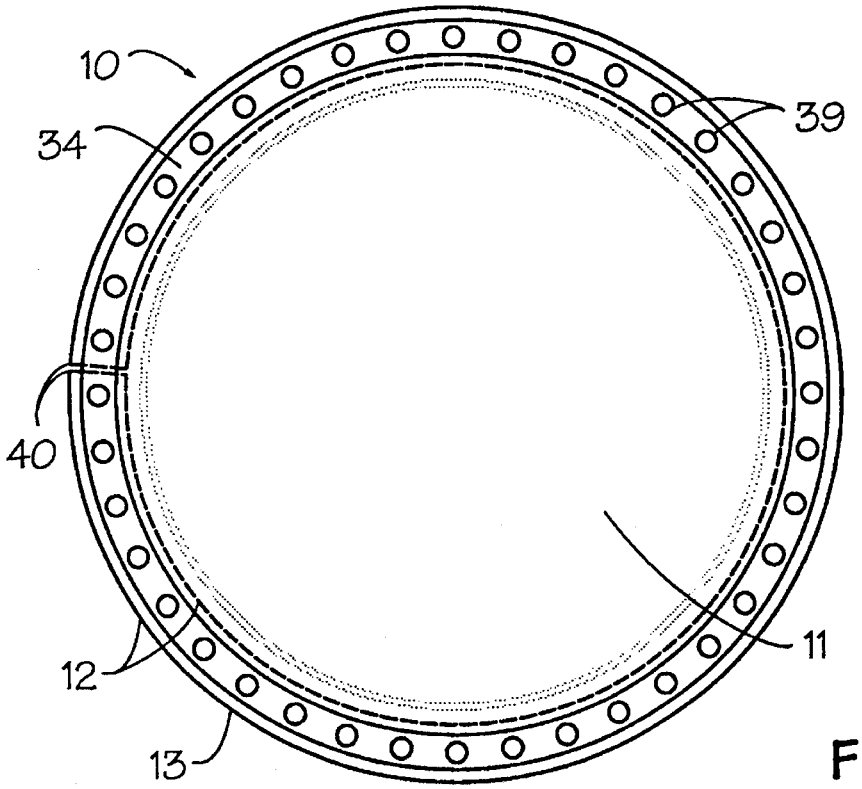
FIG. 4 is an upper plan view of a novel drum head and tensioning hoop according to the present invention.
Figure 5:
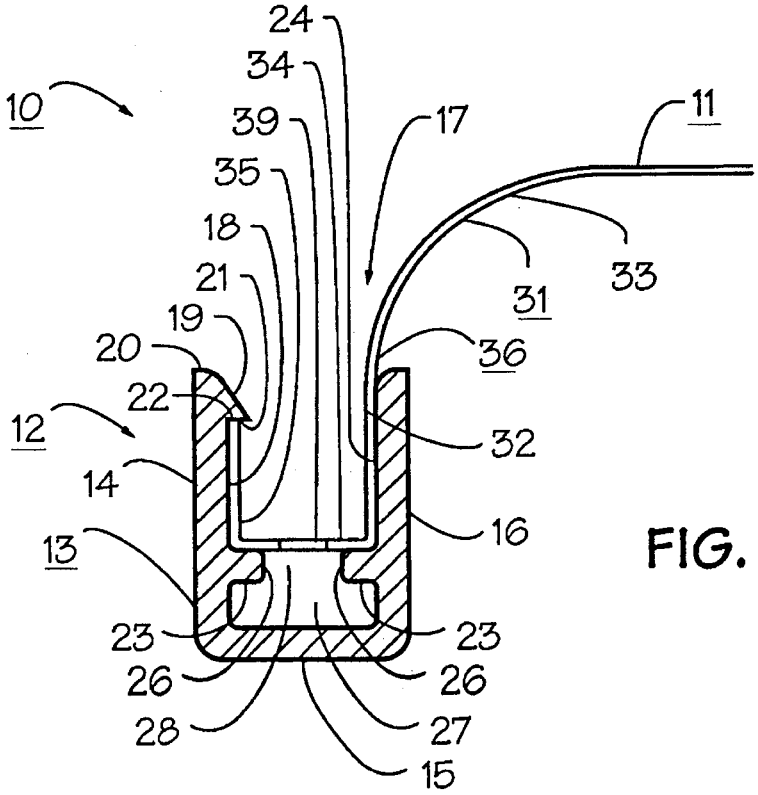
FIG. 5 is a fragmentary perspective view of the article of FIG. 4, showing it in a partly constructed stage.

As shown in FIGS. 4 and 5, a novel drum head and tensioning hoop 10 according to the present invention includes a circular disk-shaped drum head membrane 11 attached at its outer peripheral edge to a ring-shaped tensioning hoop 12. Preferably, membrane 11 is made from a thin sheet of synthetic polymer. By way of example only, a typical membrane 11 is made from polyester film having a thickness in the approximate range of 0.003 inch to 0.010 inch.

Figure 6:
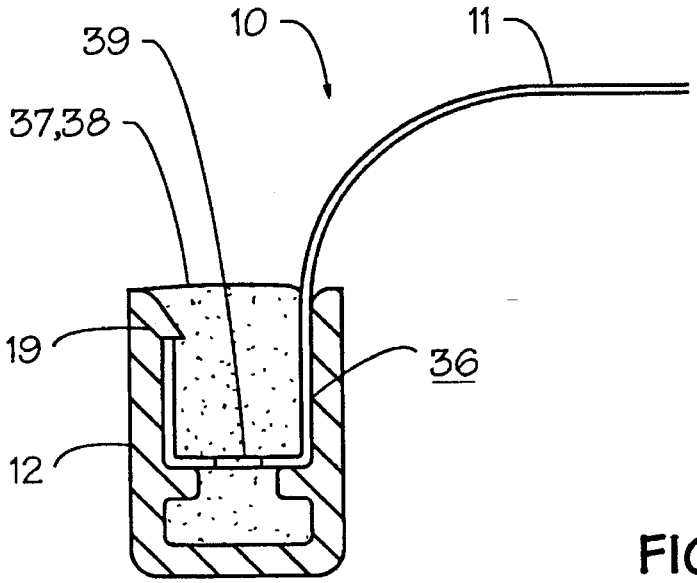
FIG. 6 is a vertical transverse sectional view of the article of FIG. 4 on an enlarged scale.
Figure 7:
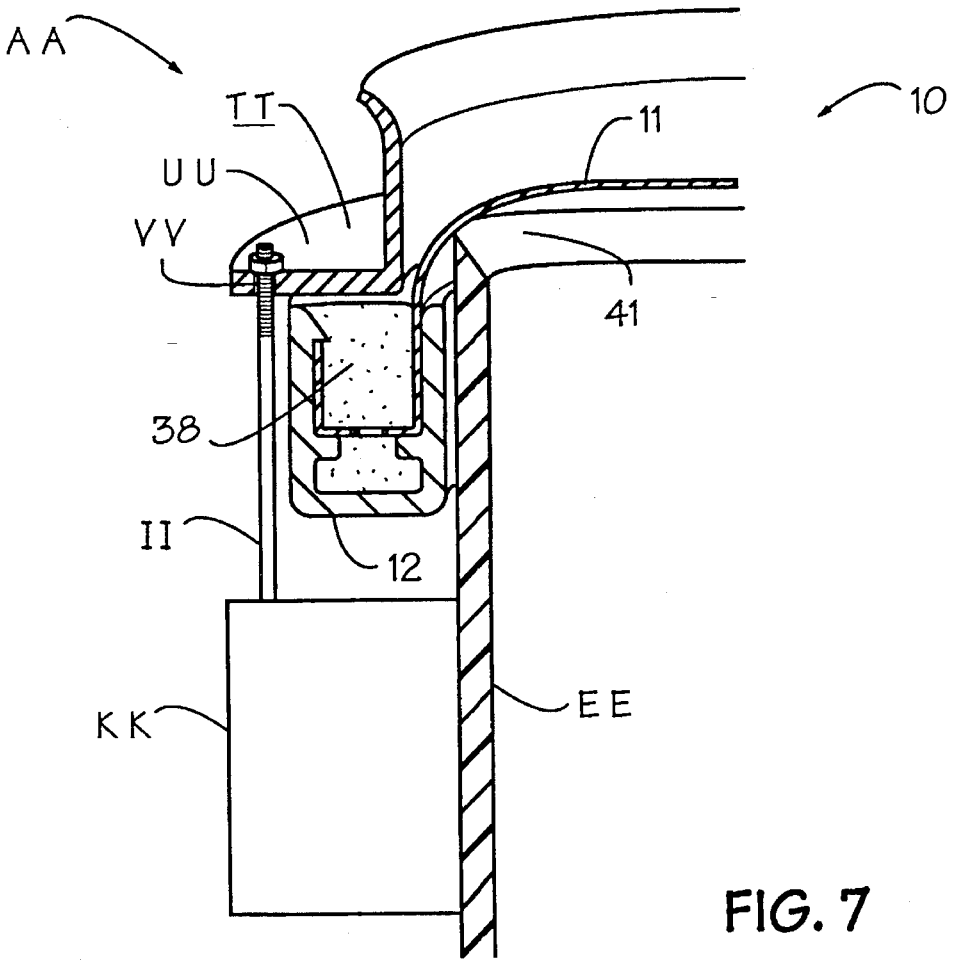
FIG. 7 is a fragmentary view of the drum head and tensioning hoop of FIG. 4, showing the article attached to a drum shell.

As may be seen best by referring to FIGS. 5–7, tensioning hoop 12 of drum head 10 comprises essentially an elongated length of channel stock 13 which is bent into a circular closed ring. As shown in FIGS. 5 and 6, the channel stock 13 has a uniform, generally U-shaped cross section. However, the cross-sectional structure of channel stock 13 is modified from a simple U-shape, in important ways which provide novel membrane positioning and locking functions according to the present invention. Thus, as shown in FIG. 5, tensioning hoop 12 is formed from an elongated length of channel stock 13 having an outer vertically disposed circumferential wall 14, a horizontally disposed bottom wall 15, and an inner vertically disposed circumferential wall 16. Thus formed, hoop 12 has therein an annular shaped upward opening groove or channel 17 having a uniform, approximately U-shaped transverse section.

As shown in FIGS. 5 and 6, the inner surface 18 of outer circumferential hoop wall 14 has formed therein an upper lip or flange 19 that protrudes radially inwards and downwards into channel 17 from the upper edge 20 of the outer channel wall. As shown in FIG. 5, lip 19 has a generally triangular shape. However, lip 19 may have other shapes, provided that it has a lower edge wall 21 adapted to abut and limit upward vertical movement of an outer peripheral edge 22 of membrane 11, as shown in FIG. 6 and which will be described below.

Referring again to FIG. 5, tensioning hoop 12 may be seen to have formed in the U-shaped channel 17 thereof a pair of opposed, thin ledges 23 that protrude inwards into the channel from inner facing surface 18 and 24 of outer and inner circumferential hoop walls 14 and 16, respectively. As shown in FIG. 6, ledges 23 of hoop 12 have a rectangular cross section of approximately the same thickness as side walls 14 and 16. Thus, an annular space 25 having a rectangularly-shaped cross section is formed between the opposed inner facing walls 26 of ledges 23. Ledges 23 also form between the lower surfaces thereof and the upper surface of bottom annular wall 15 of hoop 12 an annular space 27 having a larger rectangularly shaped cross section. Annular spaces 25 and 27 form together an annular space 28 having an inverted T-shaped cross section. Annular space 28 comprises an inverted T-shaped sub-channel within generally U-shaped channel 17 in hoop 12. The function of inverted T-shaped sub-channel 17 may be best understood with reference to FIGS. 5 and 6.

As shown in FIGS. 5 and 6, drum head membrane 11 is made from a circular disk that has an outer annular region thereof formed by the simultaneous application of heat and pressure (thermo-forming) into a curved transverse cross section. Thus, as may be seen best by referring to FIG. 6, membrane 11 has a flat, circular disk-shaped upper section 30, and a downwardly depending peripheral section 31. Peripheral section 31 of membrane 11 has a generally vertically disposed first or inner annular flange wall section 32 which is joined to upper disk-shaped section 30, preferably by an arcuately curved annular transition section 33 having a relatively large radius of curvature, approximately ¼ inch or larger. Peripheral section 31 of membrane 11 also has a flat horizontally disposed annular bottom flange wall section 34 which protrudes radially outwards from inner annular flange wall section 32, and a vertically disposed second, outer annular flange wall 35 that protrudes perpendicularly upwards from the outer annular edge of the bottom annular wall section. Annular flange wall sections 32, 34 and 35 of membrane 11 together form an annular peripheral hoop-joining section 36 having a U-shaped transverse cross section.

As shown in FIG. 6, U-shaped annular peripheral hoop-joining section 36 of membrane 11 is of the proper size and shape to fit comformally within the upper portion of U-shaped channel 17 of tensioning hoop 12. In the preferred embodiment, the height of outer vertically disposed annular flange wall 35 of membrane 11 is made slightly larger than the distance between the upper surface of ledges 23 and the lower surface of lower edge wall of lip 19 protruding inwards from outer annular wall 14 of tensioning hoop 12. Thus, when U-shaped peripheral hoop-joining section 36 of membrane 11 is inserted downwards into channel 17 of tensioning hoop 12, the transverse elasticity or springiness of outer flange wall 35 of the membrane causes the outer flange wall to exert a vertically directed compression force which lodges the flange wall between lip 19 and ledges 23. This lodging action performs two novel and important functions. First, it causes drum head membrane 11 to be located 28 precisely with respect to tensioning hoop 12. Second, the lodging action holds peripheral section 36 of membrane 11 within channel 17 of tensioning hoop 12, while the membrane is being permanently secured to the hoop. Preferably, liquid polymer is poured into the channel and solidified to permanently secure the membrane to the tensioning hoop. Thus, as shown in FIG. 6, after peripheral hoop-joining section 36 of membrane 11 has been inserted into channel 17 of the tensioning hoop and springingly held therein, polymer 37 in a liquid, unpolymerized state is poured into channel 17, above the peripheral hoop-joining section 36 of the membrane. When polymer 37 is allowed to solidify, a polymer ring 38 is formed within channel 17 and peripheral section 36 of membrane 11, the polymer ring permanently and securely fastening the membrane to tensioning hoop 12.

It is important to note that the novel and advantageous structural features of membrane 11 and tensioning hoop 12 so far described are operable even if ledges 23 were replaced by a continuous bottom channel wall, and if the membrane were unperforated. However, in the preferred embodiment of the invention, tensioning hoop 12 is constructed with ledge 23 forming an inverted T-shaped sub-channel within U-shaped channel 17. Also in the preferred embodiment, flat bottom annular wall 34 of annular peripheral section 36 of membrane 11 is provided through its thickness dimension with a plurality of circumferentially spaced apart perforations 39, as shown in FIG. 4. With this preferred construction of tensioning hoop 12 and membrane 11, liquid polymer poured into U-shaped channel 17 of tensioning hoop 12 flows through perforations 39 into an inverted T-shaped sub-channel 28, forming therein a plurality of T-shaped lugs which securely lock solidified polymer ring 38 and membrane within the tensioning hoop.

Tensioning hoop 12 may be made of a variety of materials provided that the material selected possesses sufficient rigidity, strength and dimensional stability. Since tensioning hoop 12 has a uniform transverse cross section, the channel stock 13 from which it is made may be fabricated as an extrusion. In the preferred embodiment, tensioning hoop 12 is fabricated from a straight elongated aluminum extrusion 13 which is cut to length and bent into a continuous circular ring shape with transverse end walls 40 in abutting contact, as shown in FIG. 4.

FIG. 7 illustrates the novel drum head and tensioning hoop 10 according to the present invention, installed on drum AA. As shown in FIG. 7, tensioning hoop 12 of drum head/tensioning hoop 10 is fitted circumferentially over the upper circular opening of a cylindrical drum shell EE, with the lower surface of membrane 11 in annular contact with the upper annular edge wall 41 of shell EE. Preferably, as shown in FIG. 7, upper edge wall 41 has a tapered, knife-like cross section. Axially downwardly directed forces are exerted on tensioning hoop 12 by means of a counter tensioning hoop TT abutting the upper annular surface of polymer ring 38 filling tensioning hoop 12. These downward axial forces are produced by tensioning rods II inserted through perforations VV in flanges UU protruding radially outwards from counter tensioning hoop TT, the tensioning rods being threaded into tension lugs KK attached to the outer cylindrical surface of shell EE. The novel combination of arcuately curved annular transition section 33 of membrane 11 slidable across tapered upper annular edge wall 41 of shell EE results in uniform transmission of tensile forces to disk-shaped upper battering section 30 of the membrane by tensioning rods II. This construction ensures that drum AA will maintain proper tuning for longer periods than prior art constructions.

What is claimed is:

1. A drum head for musical percussion instruments comprising:

a. a thin, flexible membrane having a flat, circular disk-shaped upper battering section, and a downwardly depending peripheral section, said peripheral section including a generally vertically disposed annular flange wall, and a generally horizontally disposed annular flange wall joined to said vertically disposed annular flange wall, b. a circular ring-shaped tensioning hoop having in the upper side thereof an elongated annular groove adapted to insertingly receive said horizontally disposed annular flange wall, c. fastening means for securing said horizontally disposed annular flange wall within said hoop said fastening means comprising an annular ring-shaped body composed of a solid polymer overlying said horizontally disposed annular flange wall.

2. The drum head of claim 1 wherein said solid polymer is further defined as a solidified liquid polymer that is poured into said elongated annular groove of said hoop.

3. The drum head of claim 2 wherein said horizontally disposed annular flange wall of said membrane is further defined as having through the thickness dimension thereof a plurality of circumferentially spaced apart holes adapted to pouringly receive liquid polymer.

4. The drum head of claim 3 further including supporting means within said channel groove of said tensioning hoop for holding said horizontally disposed membrane flange wall above the bottom annular wall of said channel groove.

5. The drum head of claim 4 wherein said supporting means is further defined as not obstructing said holes through said horizontally disposed annular flange wall of said membrane, whereby liquid polymer poured into said channel groove in said tensioning hoop may penetrate through said holes into a space between said supporting means and said bottom wall of said groove.

6. The drum head of claim 5 wherein said supporting means is further defined as being at least one annular ledge wall spaced above said bottom wall of said groove and protruding into said channel groove from an inner side wall thereof.

7. The drum head of claim 5 wherein said supporting means is further defined as being a pair of opposed annular ledges spaced above said bottom wall of said groove and protruding into said channel groove from opposite inner side walls thereof, said ledges having inner facing walls forming therebetween a space underlying said holes through said horizontally disposed membrane flange.

8. A drum head for musical percussion instruments comprising;

a. a thin, flexible membrane of substantially uniform thickness having a flat circular disk-shaped upper battering section, and a downwardly depending peripheral section elastically bendable and including a generally vertically downwardly disposed annular inner flange wall, and an upwardly disposed outer annular flange wall, b. a circular ring-shaped tensioning hoop having in the upper side thereof an elongated annular groove adapted to elastically receive said inner and outer annular flange walls of said membrane, and c. means for limiting upward movement of said upwardly disposed outer annular flange wall of said membrane, thereby precisely locking said membrane relative to said tensioning hoop when said portion of said peripheral section of said membrane including said inner and outer flange walls is inserted into said groove.

9. The drum head of claim 8 wherein said means for limiting upward movement of said upwardly disposed outer annular flange wall of said membrane is further defined as being a lip protruding inwards into said groove from the outer circumferential wall of said tensioning hoop groove, said lip being adapted to be springingly abutted by said upwardly disposed outer annular flange wall when said peripheral section of said membrane is inserted into said hoop groove, thereby lodging said membrane section within said hoop groove.

10. The drum head of claim 9 wherein said downwardly depending peripheral section of said membrane is further defined as including a generally horizontally disposed annular flange wall joining said generally vertically disposed inner and outer annular flange walls.

11. The drum head of claim 10 wherein said tensioning hoop is further defined as having protruding from the inner facing surfaces of the vertical side walls thereof a pair of opposed spaced apart annular ledges spaced above the bottom wall of said tensioning hoop, at least one of said ledges having an upper surface adapted to seat said horizontally disposed annular flange wall of said membrane at a location causing said outer upwardly disposed annular flange wall section to lodge springingly between said ledge and said lip.

12. The drum head of claim 11 wherein that portion of said horizontally disposed flange wall overlying said space between said ledges is further defined as being provided with a plurality of circumferentially spaced apart holes, whereby liquid polymer poured into said tensioning hoop groove solidifies into an inverted T-shaped locking lugs in the space between the opposed facing ledge walls, and between the lower surfaces of the ledge walls and the bottom wall of said tensioning hoop.

13. A drum head tensioning hoop comprising a circular ring having formed in the upper annular surface thereof an elongated annular groove having a generally U-shaped transverse cross section and adapted, to receive a peripheral flange section depending downwards from the disk-shaped battering section of a drum head membrane, said hoop having protruding from the inner surface of a side wall thereof a lip having a seating surface adapted to limit upward movement of an upwardly depending portion of said peripheral flange section of said membrane, and a pair of opposed spaced apart annular ledges protruding into said channel groove, said ledges being spaced above the bottom wall of said groove, and forming therewith an inverted T-shaped sub-channel within said U-shaped groove.

14. A drum head tensioning hoop comprising a circular ring having formed in the upper annular surface thereof an elongated annular groove having a generally U-shaped transverse cross section and a pair of opposed, radially spaced apart annular ledges protruding into said channel groove, said ledges being spaced above the bottom wall of said groove, and forming therewith an inverted T-shaped sub-channel within said U-shaped groove, said ledges having transversely disposed upper surfaces adapted to seat an outer peripheral flange section of a drum head membrane.

15. The tensioning hoop of claim 14 further including a lip protruding inwards from the inner surface of a side wall of said groove, said lip being adapted to limit upward movement of said outer peripheral flange section of said drum head membrane.

16. A drum head membrane made of a flexible synthetic polymer molded into a shape having elastic memory, said membrane having a generally flat, circular disk-shaped upper section, and a downwardly depending peripheral section, said peripheral section including a first, inner, generally downwardly disposed vertical annular flange wall section, a flat, generally horizontally disposed lower annular flange wall section joined to said first vertical annular flange wall section, and a second, outer, generally upwardly disposed vertical annular flange wall section joined to said horizontally disposed flange wall section, said flange wall sections forming in transverse section a U-shaped structure in which the upper edge of said outer vertical flange wall section is spaced apart from said inner vertical flange wall section.

17. The drum head membrane of claim 16 further including an arcuate cross section transition section joining said upper section to said first vertical flange wall section.

18. The drum head membrane of claim 16 wherein said inner and outer vertical flange wall sections are further defined as being substantially parallel to one another.

19. The drum head membrane of claim 16 wherein said lower flange wall section is further defined as being joined to said inner and outer vertical flange wall sections at substantially perpendicular angles.

20. The drum head membrane of claim 16 wherein said first outer vertical flange wall section is further defined as being elastically biased outwards from said inner vertical flange wall section, thereby adapting said peripheral section to be elastically retained within a U-shaped channel.

* * * * *